US008564511B2

(12) United States Patent
Weitbruch et al.

(10) Patent No.: US 8,564,511 B2
(45) Date of Patent: Oct. 22, 2013

(54) METHOD AND DEVICE FOR DISPLAYING AN IMAGE ON AN ORGANIC LIGHT EMITTING DISPLAY WHERE A FRAME IS DIVIDED INTO TWO GROUPS OF SUBFRAMES

(75) Inventors: Sebastien Weitbruch, Kappel (DE); Carlos Correa, Villingen-Schwenningen (DE); Philippe Le Roy, Betton (FR)

(73) Assignee: Thomson Licensing, Issy les Moulineaux (FR)

( * ) Notice: Subject to any disclaimer, the term of this patent is extended or adjusted under 35 U.S.C. 154(b) by 977 days.

(21) Appl. No.: 12/086,681

(22) PCT Filed: Dec. 13, 2006

(86) PCT No.: PCT/EP2006/069624

§ 371 (c)(1), (2), (4) Date: Jun. 17, 2008

(87) PCT Pub. No.: WO2007/071597

PCT Pub. Date: Jun. 28, 2007

(65) Prior Publication Data

US 2009/0021457 A1 Jan. 22, 2009

(30) Foreign Application Priority Data

Dec. 20, 2005 (EP) ..... 05292759

(51) Int. Cl.
*G09G 3/32* (2006.01)

(52) U.S. Cl.
USPC ..... 345/82

(58) Field of Classification Search
USPC ..... 345/76–100, 204–207, 690–693, 345/208–210
See application file for complete search history.

(56) References Cited

U.S. PATENT DOCUMENTS

2003/0146885 A1 8/2003 Hoppenbrouwers et al.
2003/0206185 A1* 11/2003 Thebault et al. ..... 345/690

FOREIGN PATENT DOCUMENTS

EP 1591992 2/2005
JP 2004537761 A 12/2004
WO 03012770 A2 2/2003

OTHER PUBLICATIONS

Search Report Dated Mar. 12, 2007.
Jafarabadiashtiani, "Pixel Circuits and Driving Schemes for Active-Matrix Organic Light-Emitting Diode Displays," Waterloo, Ontario, Canada, pp. 1-188, May 11, 2007 (Document previously submitted to USPTO on Apr. 9, 2012).

* cited by examiner

*Primary Examiner* — Liliana Cerullo
(74) *Attorney, Agent, or Firm* — Robert D. Shedd; Jeffrey M. Navon

(57) ABSTRACT

A method and a device for displaying an image on an Organic Light Emitting Display where a frame is divided into two groups of subframes are provided for flicker-free and very high level motion rendition. The first group of sub-frames and the at least second group of sub-frames comprise corresponding sub-frames and constitute each a complete image in a video frame and corresponding sub-frames of two groups of sub-frames have similar but not automatically the same duration. The data signal of a cell comprises plural independent elementary data signals wherein each of the elementary data signals is applied to the cell during a sub-frame and the gray scale level displayed by the cell during the respective group of sub-frames depends on the amplitude of the elementary data signals and the duration of the sub-frames.

7 Claims, 8 Drawing Sheets

METHOD AND DEVICE FOR DISPLAYING AN IMAGE ON AN ORGANIC LIGHT EMITTING DISPLAY WHERE A FRAME IS DIVIDED INTO TWO GROUPS OF SUBFRAMES

This application claims the benefit, under 35 U.S.C. §365 of International Application PCT/EP2006/069624, filed Dec. 13, 2006, which was published in accordance with PCT Article 21(2) on Jun. 28, 2007 in English and which claims the benefit of European patent application No. 05292759.7, filed Dec. 20, 2005.

The present invention relates to a method for displaying an image on an active matrix organic light emitting display. Furthermore, the present invention relates to an apparatus for displaying an image comprising an active matrix comprising a plurality of organic light emitting cells, a row driver for selecting line by line the cells of said active matrix, a column driver for receiving data signals to be applied to the cells for displaying grayscale levels of pixels of the image during a video frame and a digital processing unit for generating said data signals and control signals to control the row driver.

BACKGROUND

Figure 1:
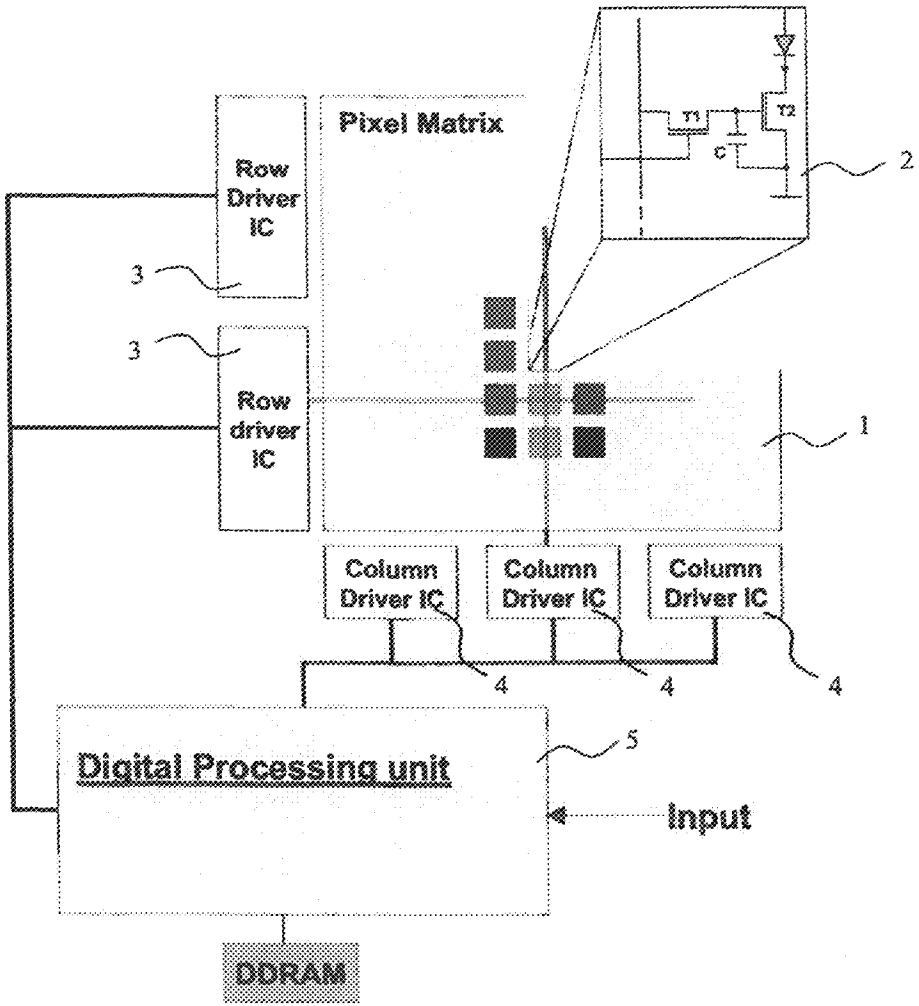
Fig. 1 PRIOR ART

The structure of an active matrix OLED or AMOLED is well known. According to FIG. 1 it comprises:

- an active matrix 1 containing, for each cell, an association of several TFTs T1, T2 with a capacitor C connected to an OLED material. Above the TFTs the capacitor C acts as a memory component that stores a value during a part of the video frame, this value being representative of a video information to be displayed by the cell 2 during the next video frame or the next part of the video frame. The TFTs act as switches enabling the selection of the cell 2, the storage of a data in the capacitor and the displaying by the cell 2 of a video information corresponding to the stored data;
- a row or gate driver 3 that selects line by line the cells 2 of the matrix 1 in order to refresh their content;
- a column or source driver 4 that delivers the data to be stored in each cell 2 of the current selected line; this component receives the video information for each cell 2; and
- a digital processing unit 5 that applies required video and signal processing steps and that delivers the required control signals to the row and column drivers 3, 4.

Actually, there are two ways for driving the OLED cells 2. In a first way, each digital video information sent by the digital processing unit 5 is converted by the column drivers 4 into a current whose amplitude is proportional to the video information. This current is provided to the appropriate cell 2 of the matrix 1. In a second way, the digital video information sent by the digital processing unit 5 is converted by the column drivers 4 into a voltage whose amplitude is proportional to the video information. This current or voltage is provided to the appropriate cell 2 of the matrix 1.

However, in principal, an OLED is current driven so that each voltage based driven system is based on a voltage to current converter to achieve appropriate cell lighting.

From the above, it can be deduced that the row driver 3 has a quite simple function since it only has to apply a selection line by line. It is more or less a shift register. The column driver 4 represents the real active part and can be considered as a high level digital to analog converter.

Figure 2:
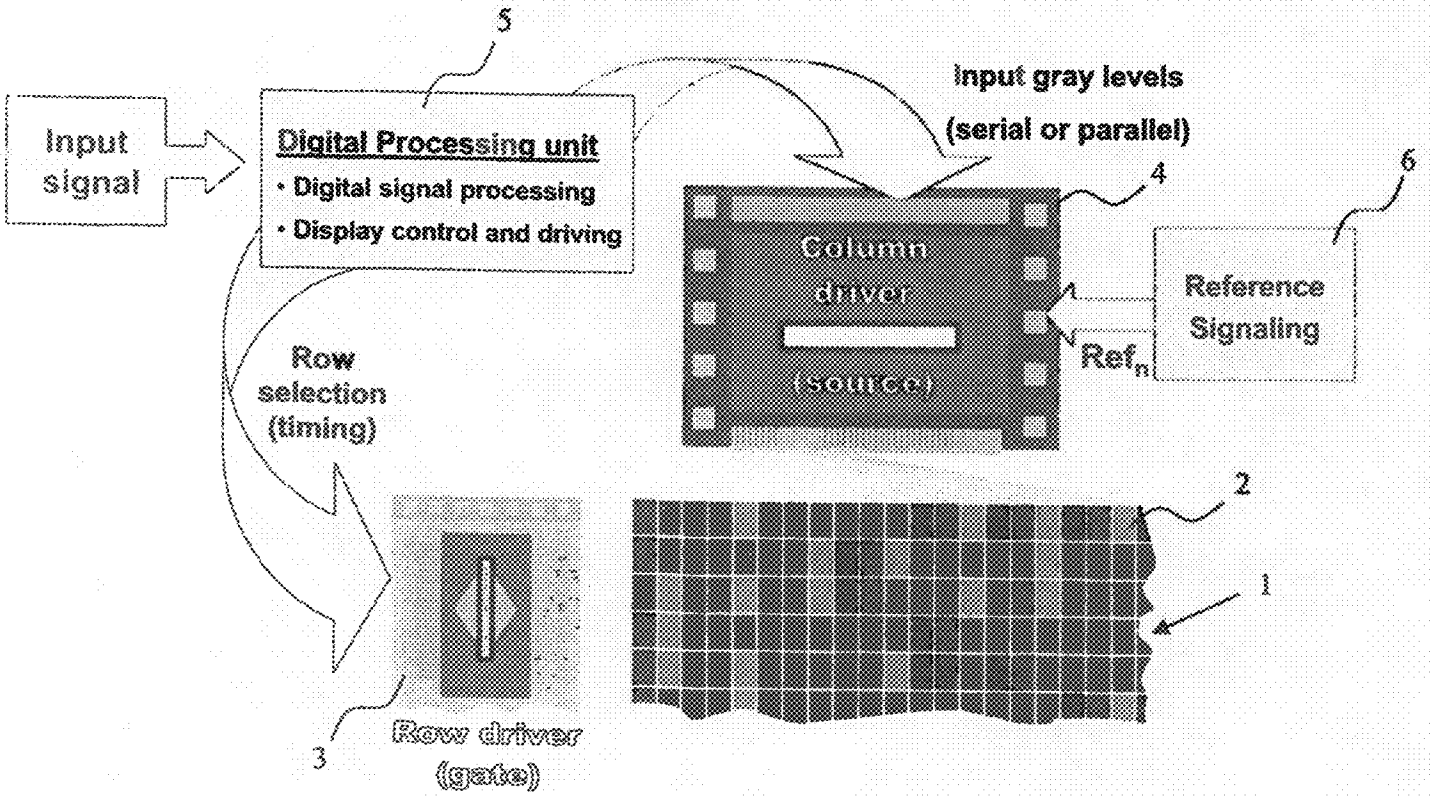
Fig. 2 PRIOR ART

The displaying of a video information with such a structure of AM-OLED is symbolized in FIG. 2. The input signal is forwarded to the digital processing unit that delivers, after internal processing, a timing signal for row selection to the row driver synchronized with the data sent to the column driver 4. The data transmitted to the column driver 4 are either parallel or serial. Additionally, the column driver 4 disposes of a reference signaling delivered by a separate reference signaling device 6. This component 6 delivers a set of reference voltages in case of voltage driven circuitry or a set of reference currents in case of current driven circuitry. The highest reference is used for the white and the lowest for the smallest gray level. Then, the column driver 4 applies to the matrix cells 2 the voltage or current amplitude corresponding to the data to be displayed by the cells 2.

A grayscale rendition without frequency doubling (e.g. case of 60 Hz or beyond) has been presented in the previous international patent application WO 05/104074 of the present applicant and will be used here as background reference. The idea was to split an analog frame as it is used today in a multiple of analog sub-frames similar to that being used in a PDP. However, in PDP each sub-frame can be only controlled in a digital way (fully ON or OFF) whereas in the concept presented there each sub-frame will be an analog one having variable amplitude, (compare FIG. 3). The number of sub-frames SF0 to SFN must be equal or higher than two and its real number will depend on the refreshing rate of the AMOLED (time required to update the value located in each pixel).

Figure 3:
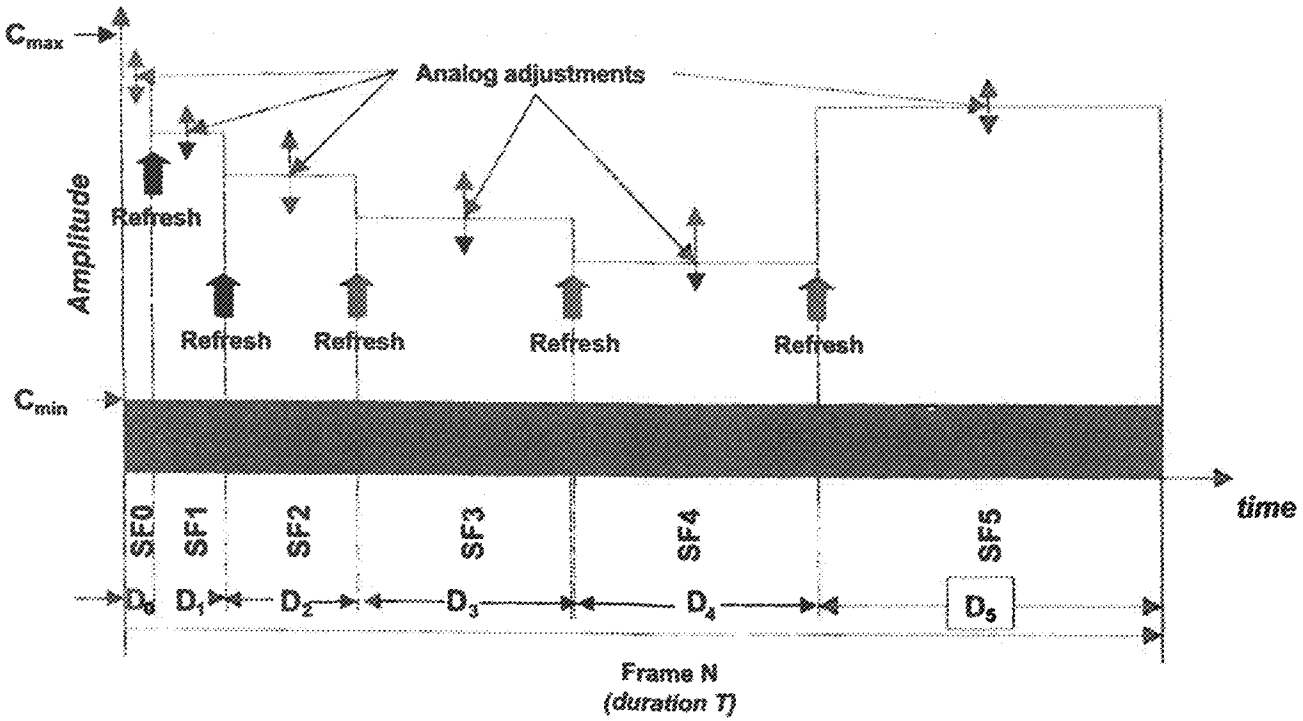
Fig. 3 PRIOR ART

FIG. 3 illustrates an example based on a split of the original video frame in 6 sub-frames (SF0 to SF5). This number is only given as an example.

The six sub-frames SF0 to SF5 have respective durations D0 to D5. During each of the sub-frames SF0 to SF5 a respective elementary data signal corresponding to the signal amplitude is used for displaying a grayscale level. In FIG. 3 the independent analog amplitude is indicated by double arrows.

A threshold $C_{max}$ represents the maximum data value of the sub-frames. The amplitude of each elementary data signal, i.e. the amplitude depicted in FIG. 3 for each sub-frame, is either $C_{black}$ or higher than $C_{min}$, wherein $C_{black}$ designates the amplitude of the elementary data signal to be applied to a cell for disabling light emission. $C_{min}$, which is higher than $C_{black}$, is a threshold that represents a value of a data signal above which the working of the cell is considered as good (fast ride, good stability). Furthermore, a refresh cycle is applied between two sub-frames in order to update the information stored in the capacitor C (compare FIG. 1).

Figures 4, 5:
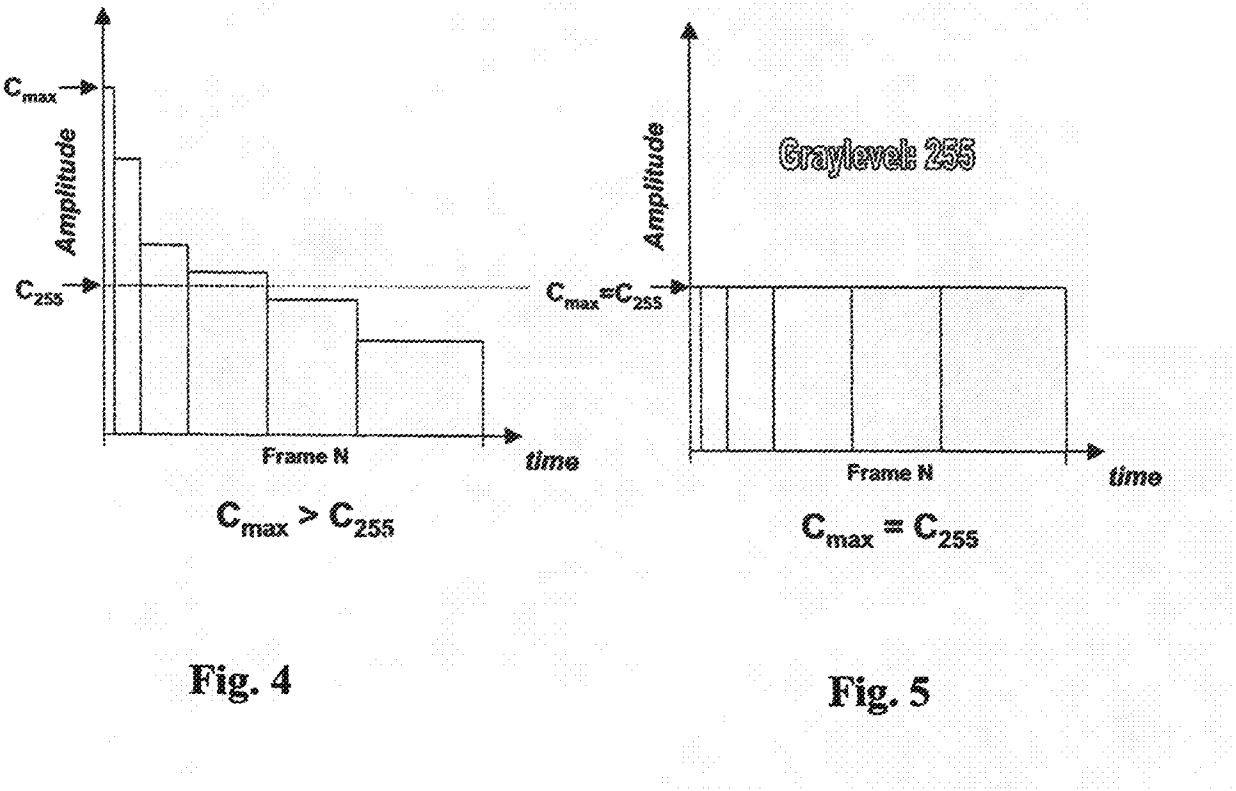
Fig. 5 PRIOR ART

FIGS. 4 and 5 illustrate the rendition of the white level (video level 255) for two possibilities of $C_{max}$ as disclosed before ($C_{max}=C_{255}$ or $C_{max}>C_{255}$).

The sub-frame structure of FIG. 4 would lead to a light emission similar to that of a CRT whereas the emission of white based on the sub-frame structure of FIG. 5 is similar to conventional methods.

Both solutions are equivalent for the low level rendition. In the same way the solutions are similar for the rendition of low levels up to mid gray concerning the motion rendition. However, the concept described in FIG. 4 has the advantage of offering a better motion rendition for all levels specifically in the range of high levels. Generally, the solution of FIG. 4 presents much more advantages. However, the maximal driving signals $C_{max}$ used for some sub-frames is much higher and could have an impact on the display lifetime. This item will define which concept should be used (a compromise between both is also realistic).

Another main advantage of the solution of FIG. 4 is that the analog amplitude of a sub-frame is defined via a driver as presented on FIG. 2. If the driver is a 6-bit driver for instance, for each sub-frame there is the possibility to have a 6-bit resolution on its analog amplitude. Finally, due to the split of the frames in many sub-frames, each one being on 6-bit basis, one can dispose of much more bits due to the combination of sub-frames.

Beside this grayscale rendition without frequency doubling the concept of grayscale rendition with frequency doubling (e.g. case of 50 Hz or large screen) is also known.

Figure 6:
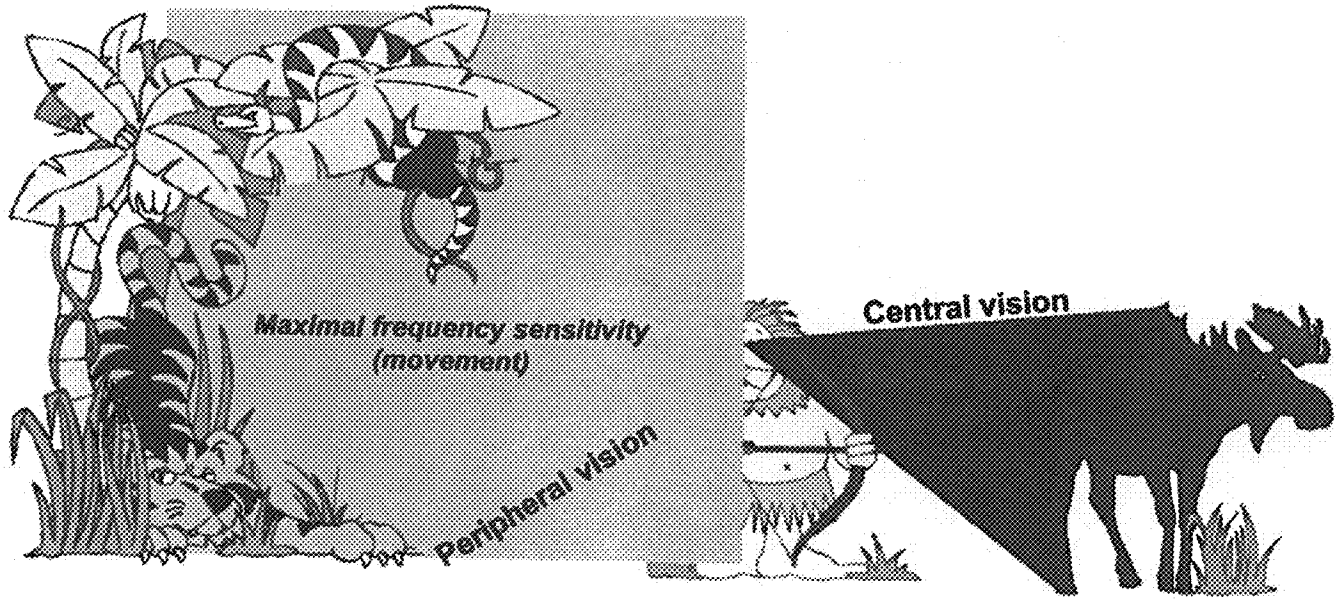
Fig. 6 PRIOR ART

Derived from evolution, humans were hunters who needed a very strong acuity in the middle of their visual field to lock their prey. At the same time, they needed the possibility to detect a danger (slight movement of wild animals, enemy . . . ) on the periphery of their visual field as illustrated in FIG. 6. Therefore, the retina is a non-homogeneous neurosensory layer. Its central part (fovea) provides a maximal acuity in terms of spatial resolution whereas the peripheral region is more sensitive to movement (temporal resolution). This peripheral sensitivity to temporal frequencies is graphically described in FIG. 7 for different levels of luminance. This eye behavior is the source of the large-area flickering effect that appears on the visual field periphery only. In addition, this effect strongly evolves with the luminance of the scene.

In the case of new flat display technology, the brightness of the screen is limited by the panel efficacy, which is constantly improved. This brightness improvement combined with increasing screen sizes will increase the perception of the large area flickering for the customer's eye up to a real disturbing effect.

In the case of standard AMOLED driving, there is no real notion of temporal frequency since the signal is constant among the whole frame and is not a pulse as it is the case in a CRT. Therefore, there is also no real problem of large-area flickering. However, when performing a pulsing grayscale rendition as shown in FIG. 4, a notion of flicker is introduced again.

INVENTION

It is the object of the present invention to reduce the notion of flicker when performing pulsing grayscale rendition while keeping the advantage of the motion rendition.

According to the present invention this object is solved by a method for displaying an image in an active matrix organic light emitting display (AMOLED) comprising a plurality of cells, wherein a data signal is applied to each cell for displaying a first grayscale level of a pixel of the image during a first group of sub-frames and for displaying at least a second grayscale level of a pixel of the image during at least a second group of sub-frames, the first group of sub-frames and the at least second group of sub-frames are constituting a video frame, each group of sub-frames is divided into a plurality of sub-frames, each the first group of sub-frames and the second group of sub-frames are belonging to a separate complete image on the display (AMOLED), and the data signal of a cell comprises plural independent elementary data signals, each of said elementary data signals being applied to the cell during a sub-frame and the grayscale level displayed by the cell during the respective group of sub-frames depending on the amplitude of the elementary data signals and the duration of the sub-frames.

Furthermore, there is provided an apparatus for displaying an image comprising an active matrix comprising a plurality of organic light emitting cells, a row driver for selecting line by line the cells of said active matrix; a column driver for receiving data signals to be applied to the cells for displaying grayscale levels of pixels of the image during a video frame, and a digital processing unit for generating said data signals and control signals to control the row driver, wherein the video frame is divided into a first group of sub-frames and at least a second group of sub-frames, each group of sub-frames is divided into a plurality of sub-frames, and each the first group of sub-frames and the second group of sub-frames are belonging to a separate complete image to be displayed on the active matrix, and the data signals each comprising plural independent elementary data signals can be generated by said digital processing unit, each of said elementary data signals being applicable via the column driver to a cell during a sub-frame, the grayscale level displayed by the cell during the respective group of sub-frames depending on the amplitude of the elementary data signals and the duration of the sub-frames.

In other words, each cell of the active matrix organic light emitting display is driven at least two times independently during one video frame period. Thus, each cell produces at least two gray levels during a single video frame. Of course, each video frame may also be divided in three, four or more groups of sub-frames.

Preferably, the numbers of sub-frames in two of the groups of sub-frames of one video frame are equal. However, the numbers of sub-frames in two of the groups of sub-frames of one video frame also may be different. This allows more flexibility for a picture coding.

Corresponding sub-frames of two groups of sub-frames of one video frame may have similar but not exactly the same duration. This also enhances the flexibility for a picture coding.

According to a further preferred embodiment the first and the second group of sub-frames of one video frame are identical. Thus, the same picture is represented twice during a video frame period. Consequently, large area flicker is less visible.

Moreover, each group of sub-frames may belong to an independent image of a 100 Hz progressive source. This enables displaying of complete pictures at least two times during a video frame period.

The inventive apparatus may additionally be provided with a controller for switching the active matrix to a first video mode, wherein one video frame is used for a group of sub-frames, and a second video mode, wherein one video frame is divided into at least two groups of sub-frames. Thus, the controller can choose the right display driving depending on the input format or user selection.

Additionally, the controller may allow switching into a PC-mode, wherein one video frame is represented by a single sub-frame. This is useful when driving simple PC monitors.

DRAWINGS

Figure 7:
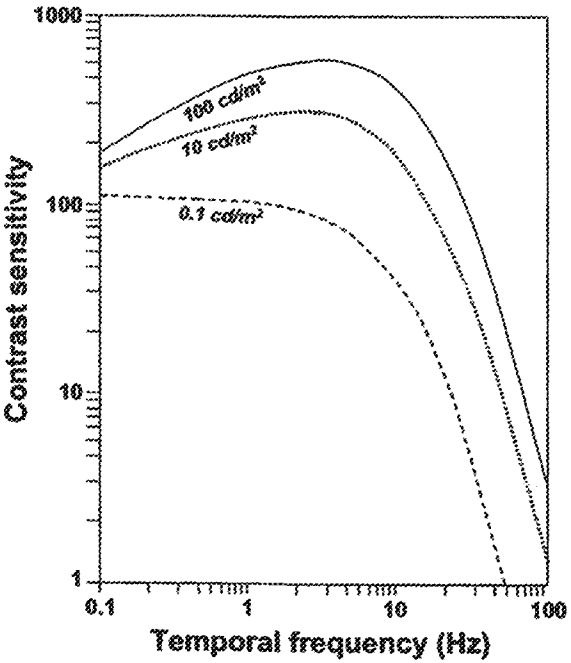
Fig. 7 PRIOR ART
Figure 8:
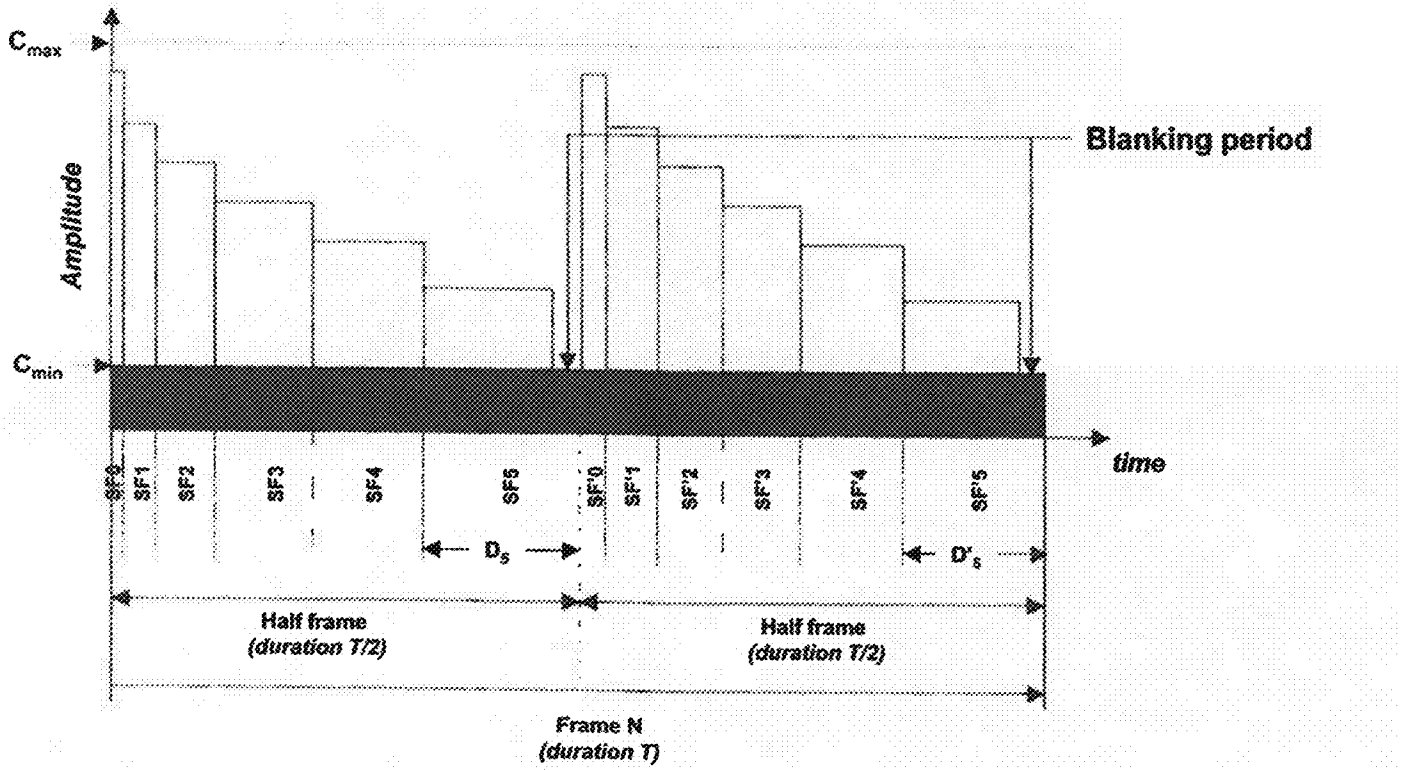
Figure 9:
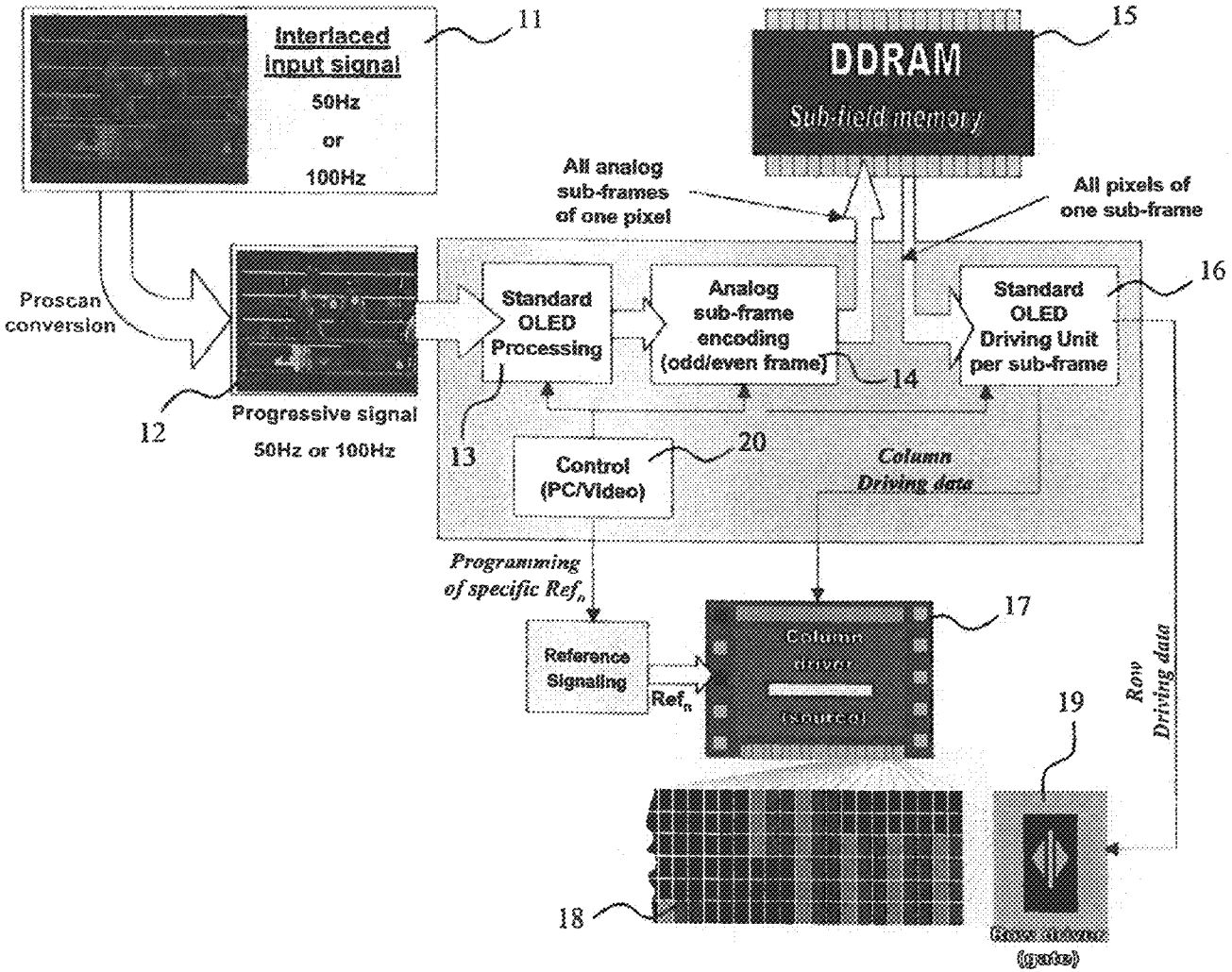

Exemplary embodiments of the invention are illustrated in the drawings and are explained in more detail in the following description. The drawings showing in FIG. 1 a principal diagram of the electronics of an AMOLED;

FIG. 2 a principal diagram of AMOLED drivers;

FIG. 3 an AMOLED grayscale rendition with analog sub-frames;

FIG. 4 a specific grayscale rendition with analog sub-frames;

FIG. 5 an alternative grayscale rendition with analog sub-frames;

FIG. 6 a functional specification of the human retina;

FIG. 7 the eye temporal response;

FIG. 8 an AMOLED grayscale rendition with frequency-doubling on analog sub-frames; and FIG. 9 a concept of implementation.

DESCRIPTION OF PREFERRED EMBODIMENTS

The essential idea of the present invention resides in a new analog sub-frame distribution. This analog sub-frame distribution is based on two groups of sub-frames having similar temporal duration and being located in two half-frame periods as shown in FIG. 8. This (solution) leads to an artificial frequency doubling. The input frame is split in two equivalent half- frames, each of them being split again in a certain amount of sub-frames (two times 6 in this example).

It is mandatory that sub-frames SFn and SF'n have similar duration but not automatically exactly the same. The number of sub-frames in both half-frames may also be different as far as the total duration of both half-frames is nearly the same. Moreover, also the amplitudes of the corresponding sub-frames in both half-frames, for example SF0 and SF'0 may be slightly different. This allows even more flexibility by picture coding. However, if the durations are exactly the same the quality in terms of flickering is better. A suitable compromise for the targeted application has to be found.

FIG. 8 shows a blanking period at the end of each half-frame. This blanking period is not mandatory but serves as margin of the half-frames.

In any case, the application is not only limited to low frequencies like 50 Hz. It is also suitable for close-to-eye applications (portable device) or for larger screens that use higher frequencies but that more affect the eye periphery and thus are more critical.

The inventive encoding enables to reduce the large area flickering by an artificial frequency doubling when controlling an AMOLED with analog sub-frame encoding. In the following, there are given two possibilities for a 100 Hz AMOLED by using the inventive encoding:

In a standard application the picture source is 50 Hz interlaced and the signal is converted to progressive 50 Hz signal by an intermediate block. This new 50 Hz progressive signal is used as an input for the encoding presented in FIG. 8. In that case, both groups of sub-frames SFn and SF'n are based on the same input picture. This will introduce a judder as it was the case in former 100 Hz CRTs.

An improved version is based on a 100 Hz TV chassis (or similar front-end block) that delivers a 100 Hz-interlaced signal. This signal must be then converted to a 100 Hz progressive signal which uses all lines of a picture. In that case all sub-frames SFn of the first group will correspond to one odd delivered picture whereas all sub-frames SF'n of the second group will correspond to the even delivered picture.

FIG. 9 illustrates a possible implementation of the analog sub-frame encoding concept for an AMOLED. The input signal 11 is coming from a TV chassis (or front-end unit) with an interlaced format (50 Hz or 100 Hz). This input signal 11 is then converted, for example by so called PROSCAN conversion to a progressive format (in the TV chassis/front-end or in an additional block) leading to a progressive signal 12 with 50 Hz or 100 Hz refresh-rate. This progressive signal 12 is forwarded to the standard OLED processing block 13 as usual. The output of this block 13 is forwarded then to a transcoding table within an analog sub-frame encoding block 14 that can work in two modes:

Input at 50 Hz—the transcoding table delivers n+n' values for a given pixel, n being the number of analog sub-fields for the first and n' for the second part of the displayed frame as shown on FIG. 8. In that case the sub-frames for the first period (T/2) and for the second period are extracted from the same video value. The whole system is working on a basis of 20 ms. The same can be applied to a 60 Hz source if needed.

Input at 100 Hz—the transcoding table delivers only n values from a picture to be displayed :one set n for odd pictures, one set n (=n') for even pictures. In that case the sub-frames for the first period (T/2) and for the second period are extracted from different video values, one coming from odd frames and one from even frames. The whole system is working on a basis of 10 ms. The last concept has the advantage of offering a flicker-free and very high-level of motion rendition. The same can be applied to a 120 Hz source if needed.

All outputs from the encoding block 14 are stored at different positions of the sub-field memory 15 that finally contains n+n' frames, each one with the resolution required by the column driver 17. Afterwards, an OLED driving unit 16 is reading all pixel values of a given sub-frame k before reading the same information of the sub-frame k+1 from memory 15. The OLED driving unit 16 is in charge of updating all pixels of the display 18 with this information and also it is in charge of the duration time between two display operations (duration Dn of a given sub-frame, compare FIG. 3). The memory 15 must contain two areas for information storage: one area for writing and one for reading to avoid any conflict. The areas are permuted from frame to frame.

The OLED driving unit transmits column driving data to the column driver 17 and row driving data to a row driver 19. Both, the column driver 17 and the row driver 19, drive the AMOLED display 18.

A controller 20 is responsible for choosing the right display format:

PC mode—standard display using a video frame with no sub-frame or a video frame with a plurality of sub-frames for which the corresponding elementary data signals have the same maximal values as illustrated by FIG. 5;

Video-mode 1—for non flicker critical inputs (>60 Hz and small display, higher frame rate) using a greyscale rendition without frequency doubling;

Video-mode 2—for flicker critical inputs (50 Hz, close-view display, big displays) using a greyscale rendition with frequency doubling corresponding to the inventive method.

The controller 20 is connected to the OLED processing block 13, the sub-frame encoding block 14 and the OLED driving unit 16. Furthermore, the controller 20 is connected to a reference signalling block 21 for delivering a set of reference voltages or currents, respectively, to the column driver 17. The highest reference is used for the white and the lowest or the smallest gray level.

The invention claimed is:

1. Method for displaying an image on an active matrix organic light emitting display where a video frame is divided in two groups of subframes, wherein a data signal is applied to each cell of the active matrix organic light emitting display for displaying a first grayscale level of a pixel of the image during a first group of sub-frames and for displaying a second or further grayscale level of the same pixel of the image during a second or further groups of sub-frames by dividing the subframes of a frame into the first group of sub-frames and at second or further groups of sub-frames, the first group of sub-frames and the at second or further groups of sub-frames are constituting a-the video frame, each group of sub-frames is divided into a plurality of sub-frames, wherein corresponding sub-frames of two groups of sub-frames have similar but not automatically the same duration, the first group of sub-frames and the second group or the further grows of sub-frames form each a complete image on the display, and the data signal of a cell comprises plural independent elementary data signals, each of said elementary data signals being applied to the cell during a sub-frame and the grayscale level displayed by the cell during the respective group of sub-frames depending on the amplitude of the elementary data signals and the duration of the sub-frames.

2. Method according to claim 1, wherein the numbers of sub-frames in two of the groups of sub-frames of one video frame are equal and each number of subframes of a group forms as complete image.

3. Method according to claim 1, wherein the first and second group of sub-frames of one video frame, wherein each group represents a complete image, the groups are identical concerning amplitude or duration of the corresponding sub-frames.

4. Method according to claim 1, wherein each group of sub-frames forms an independent image of a 100 Hz progressive source.

5. Device for displaying an image on an active matrix organic light emitting display where a video frame is divided in two groups of subframes, comprising a row driver for selecting line by line cells of said active matrix;

a column driver for receiving data signals to be applied to the cells for displaying grayscale levels of pixels of the image during the video frame, and a digital processing unit for generating said data signals and control signals to control the row driver, wherein the video frame is divided into a first group of sub-frames and a second or further groups of corresponding sub-frames, wherein corresponding sub-frames of two groups of sub-frames have similar but not automatically the same duration and each the first group of sub-frames and the second or further groups of sub-frames form each a complete image to be displayed on the active matrix, and the data signals each comprising plural independent elementary data signals can be generated by said digital processing unit, each of said elementary data signals being applicable via the column driver to a cell during a sub-frame, the grayscale level displayed by the cell during the respective group of sub-frames depending on the amplitude of the elementary data signals and the duration of the sub-frames.

6. Apparatus according to claim 5, further including a controller for switching the active matrix into a first video mode, wherein one video frame is used for a group of sub-frames, and a second video mode, wherein one video frame is divided into at least two groups of sub-frames.

7. Apparatus according to claim 6, wherein the controller allows switching into a PC-mode, wherein one video frame comprises no sub-frame or comprises a plurality of sub-frames for which the corresponding elementary data signals have the same maximal values.

* * * * *